United States Patent [19]

Hargreaves et al.

[11] 4,415,434

[45] Nov. 15, 1983

[54] MULTIPLE STAGE DESALTING AND DEDUSTING PROCESS

[75] Inventors: Jay T. Hargreaves, Bolingbrook, Ill.; Albert L. Hensley, Munster, Ind.

[73] Assignee: Standard Oil Company (Ind.), Chicago, Ill.

[21] Appl. No.: 285,601

[22] Filed: Jul. 21, 1981

[51] Int. Cl.[3] ..... C10G 1/00; C10G 31/08

[52] U.S. Cl. ..... 208/11 R; 208/8 R; 208/251 R; 208/177

[58] Field of Search ..... 208/251 R, 8 R, 11 R

[56] References Cited

U.S. PATENT DOCUMENTS

| | | | |
|---|---|---|---|
| 2,446,040 | 7/1948 | Blair, Jr. | 208/251 R X |
| 2,789,083 | 4/1957 | Hardy | 208/251 R |
| 3,888,760 | 6/1975 | Ebert | 208/251 R X |
| 4,293,401 | 10/1981 | Sieg et al. | 208/11 R |

OTHER PUBLICATIONS

Congram, G. E., *Refiners Zeroin on Better Desalting* Oil and Gas Journal, Dec. 30, 1974, pp. 153–154.

Waterman, L. C., *Crude Desalting: Why and How* Hydrocarbon Processing and Petroleum Refiner, Feb. 1965, p. 133, vol. 44, No. 2.

*Primary Examiner*—Delbert E. Gantz

*Assistant Examiner*—Glenn A. Caldarola

*Attorney, Agent, or Firm*—Thomas W. Tolpin; William T. McClain; William H. Magidson

[57] ABSTRACT

A process is provided to dedust oil derived from solid hydrocarbon-containing material, such as oil shale, coal or tar sand in multi-stage desalters. In the process, water is dispersed into the oil before entering each desalter to form an emulsion. The desalter separates the emulsion into a stream of oil having a substantially lower concentration of dust and a dusty stream of water containing most of the dust. In one embodiment, the sludge-like dusty stream from the first desalter is combusted in a lift pipe and used as heat carrier material in the retort. In other embodiments, the dusty stream from the first desalter is centrifuged or filtered and thereafter heated in a dryer to remove residual oil and water from the stream before the stream is combusted in the lift pipe and used as heat carrier material in the retort and dryer. Effluent water from the second and third desalters as well as from the centrifuge or filter are recycled upstream and dispersed in the oil.

50 Claims, 10 Drawing Figures

MULTIPLE STAGE DESALTING AND DEDUSTING PROCESS

BACKGROUND OF THE INVENTION

This invention relates to synthetic fuels, and more particularly, to a process for dedusting oil laden with dust derived from solid, hydrocarbon-containing material such as oil shale, coal and tar sand.

Researchers have now renewed their efforts to find alternate sources of energy and hydrocarbons in view of recent rapid increases in the price of crude oil and natural gas. Much research has been focused on recovering hydrocarbons from solid hydrocarbon-containing material such as oil shale, coal and tar sand by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, propane, and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in aboveground vessels or in situ retorts underground. In principle, the retorting of shale and other hydrocarbon-containing materials, such as coal and tar sand, comprise heating the solid hydrocarbon-containing material to an elevated temperature and recovering the vapors and liberated effluent. However, as medium grade oil shale yields approximately 25 gallons of oil per ton of shale, the expense of materials handling is critical to the economic feasibility of a commercial operation.

In surface retorting, oil shale is mined from the ground, brought to the surface, crushed and placed in vessels where it is contracted with a hot heat transfer carrier, such as ceramic or metal balls, hot spent shale or sand for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spend oil shale relatively free of carbon. Spent oil shale which has been depleted in carbonaceous material is removed from the reactor and recycled as heat carrier material or discarded. The combustion gases are dedusted in a cyclone or electrostatic precipitator.

Some well-known processes of surface retorting are: N-T-U (Dundas Howes retort), Kiviter (Russian), Petrosix (Brazilian), Lurgi-Ruhrgas (German), Tosco II, Galoter (Russian), Paraho, Koppers-Totzek, Fushum (Manchuria), gas combustion and fluid bed. Process heat requirements for surface retorting processes may be supplied either directly or indirectly.

During fluid bed, moving bed and other types of surface retorting, decrepitation of oil shale occurs creating a popcorning effect in which particles of oil shale collide with each other and impinge against the walls of the retort forming substantial quantities of minute entrained particulates of shale dust. The use of hot spent shale or sand as heat carrier material aggravates the dust problem. Rapid retorting is desirable to minimize thermal cracking of valuable condensable hudrocarbons, but increases the rate of decrepitation and amount of dust. Shale dust is also emitted and carried away with the effluent product stream during modified in situ retorting as a flame front passes through a fixed bed of rubblized shale, as well as in fixed bed surface retorting, but dust emission is not as aggravated as in other types of surface retorting.

Shale dust ranges in size from less than 1 micron to 1000 microns and is entrained and carried away with the effluent product stream. Because shale dust is so small, it cannot be effectively removed to commercially acceptable levels by conventional dedusting equipment.

The retorting, carbonization or gasification of coal, peat and lignite and the retorting or extraction of tar sand and gilsonite create similar dust problems.

After retorting, the effluent product stream of liberated hydrocarbons and entrained dust is withdrawn from the retort through overhead lines and subsequently conveyed to a separator, such as a single or multiple stage distillation column, quench tower, scrubbing cooler or condenser, where it is separated into fractions of light gases, light oils, middle oils and heavy oils with the bottom heavy oil fraction containing essentially all of the dust. As much as 50% by weight of the bottom heavy oil fraction consists of dust.

It is very desirable to upgrade the bottom heavy oil into more marketable products, such as light oils and middle oils, but because the heavy oil fraction is laden with dust, it is very viscous and cannot be pipelined. Dust laden heavy oil plugs up hydrotreaters and catalytic crackers, gums up valves, heat exchangers, outlet orifices, pumps and distillation towers, builds up insulative layers on heat exchange surfaces reducing their efficiency and fouls up other equipment. Furthermore, the dusty heavy oil corrodes turbine blades and creates emmission problems. If used as a lubricant, dusty heavy oil is about as useful as sand. Moreover, the high nitrogen content in the dusty heavy oil cannot be refined with conventional equipment.

In an effort to solve this dust problem, electrostatic precipitators have been used as well as cyclones located both inside and outside the retort. Electrostatic precipitators and cyclones, however, must be operated at very high temperatures and the product stream must be maintained at or above the highest temperature attained during the retorting process to prevent any condensation and accumulation of dust on processing equipment. Maintaining the effluent stream at high temperatures is not only expensive from an energy standpoint, but it allows detrimental side reactions, such as cracking, coking and polymerization of the effluent product stream, which tends to decrease the yield and quality of condensable hydrocarbons.

Over the years various processes and equipment have been suggested to decrease the dust concentration in the heavy oil fraction and/or upgrade the heavy oil into more marketable light oils and medium oils. Such prior art dedusting processes and equipment have included the use of cyclones, electrostatic precipitators, pebble beds, scrubbers, filters, electric treaters, spiral tubes, ebullated bed catalytic hydrotreaters, desalters, autoclave settling zones, sedimentation, gravity settling, percolation, hudrocloning, magnetic separation, electrical precipitation, stripping and binding, as well as the use of diluents, solvents and chemical additives before centrifuging. Typifying those prior art processes and equipment and related processes and equipment are those found in U.S. Pat. Nos. 2,235,639; 2,717,865; 2,719,114; 2,723,951; 2,793,104; 2,879,224; 2,899,736; 2,904,499; 2,911,349; 2,952,620; 2,968,603; 2,982,701; 3,008,894; 3,034,979; 3,058,903; 3,252,886; 3,255,104; 3,468,789; 3,560,369; 3,684,699; 3,696,021; 3,703,442; 3,784,462; 3,799,855; 3,808,120; 3,900,389; 3,901,791; 3,929,625; 3,974,073; 3,990,885; 4,028,222; 4,040,958; 4,049,540; 4,057,490; 4,069,133; 4,080,285; 4,088,567; 4,105,536; 4,151,073; 4,159,949; 4,162,965; 4,166,441; 4,182,672; 4,199,432; 4,220,522; 4,226,690; 4,230,557; and 4,246,093 as well as in the articles by Rammler, R. W., *The Retorting of Coal, Oil Shale, and Tar Sands by Means of Circulated Fine-Grained Heat Carriers as a Preliminary Stage in the Production of Synthetic Crude Oil,* Volume 65, Number 4, Quarterly of the Colorado School of Mines, Pages 141–167 (October 1970) and Schmalfed, I. P., *The Use of the Lurgi/Ruhrgas Process for the Distillation of Oil Shale,* Volume 70, Number 3, Quarterly of the Colorado School of Mines, pages 129–145 (July 1975). These prior art processes and equipment have not been successful in decreasing the dust concentration in the heavy shale oil fraction to commercially acceptable levels.

Single and two stage desalters have been used for many years to desalt crude oil. Crude oil as it is received at the refinery averages about 0.25% basic sediment and water with salt contents from 3 ptb (pounds per thousand barrels of crude) to 200 ptb. As originally applied, desalting meant removal of about 90% of the chlorides of sodium, calcium and magnesium, collectively referred to as "brine," in the salty connate water which if not removed would produce hydrogen chloride and ultimately hydrochloric acid in refinery equipment at about 250° F. Although the term is still the same, desalting now broadly refers to eliminating a variety of contaminants in crude oil, including sulfates. Two stage desalting can remove as much as 99% of the salt in connate water. Desalting also removes from 50% to 75% of the inorganic sediment is crude oil, namely, fine particles of sand, clay, volcanic ash, drilling mud, rust, iron sulfide, metal and scale. Arsenic and iron contained in organic sediment in crude oil are also removed and decreased by the desalter to tolerable limits. Other trace metals in crude oil, such as vanadium, nickel, aluminum, barium and copper are removed to a much lesser extent.

Conventional desalting is described in Waterman, L. C., *Theories and Benefits of Desalting,* Tech. 64–37, National Petroleum Refiners Association (1964); Congram, G. E., *Refiners Zero In on Better Desalting,* Oil and Gas Journal, pages 153–154 (Dec. 30, 1974); Smith, R. S., *How to Calculate Rapidly for Two-Stage Desalting,* Oil and Gas Journal Sept. 30, 1974); Frazier A. W., *Optimized Two-Stage Desalting of Crude Oil,* M75–79, Research and Development Department, Amoco Oil Company (1975); and *Two-Stage Desalting of Crude Oil and Its Economic Justifications,* Petreco Division, Petrolite Corporation, containing Fisher, L. E., et al., *Crude Oil Desalting,* reprinted from Vol. 1, No. 5, Materials Protection pages 8–11 and 14–17 (May 1962), *Petreco Crude Oil Desalting* and Waterman, L. C., *Crude Desalting: Why and How,* Hydrocarbon Processing and Petroleum Refiner (February 1965).

Attempts have been made to dedust shale oil in a single stage desalter with limited success.

It is therefore desirable to provide an improved process, which overcomes most, if not all, of the preceding problems.

SUMMARY OF THE INVENTION

An improved process is provided which utilizes multi-stage desalters to dedust oil derived from solid hydrocarbon-containing material such as oil shale, coal or tar sand, into one or more purified (dedusted) streams of oil. Advantageously, the dedusted oil can be safely pipelined through valves, outlet orifices, pumps, heat exchangers and distillation columns and can be refined in hydrotreaters and catalytic crackers.

The oil can be derived from in situ retorting or surface retorting, such as in a fluid bed retort or screw conveyor retort where hot spent hydrocarbon-containing material is used as heat carrier material to retort raw oil shale, coal or tar sand, and in which the retorted effluent product stream is processed in a single or multiple stage separator, such as one or more quench towers, scrubbers, condensors or distillation columns, sometimes referred to as "fractionating columns" or "fractionators," into a whole oil fraction or heavy oil fraction laden with particulates of dust derived from the solid hydrocarbon-containing material. Typically, the whole oil fraction contains from 10% to 15% by weight dust and the heavy oil fraction, which is from 15% to 35% by weight of the effluent product stream, contains as much as 25% to 50% by weight dust.

In the novel process, from 10% to 50% and preferably a maximum of 30% by volume water is dispersed in and mixed with dust laden oil to form an emulsion. The emulsion is separated in a first desalter into a purified (dedusted) stream of oil containing from 1500 ppm (parts per million) (0.15%) to 15,000 ppm (1.5%) by weight dust leaving a residual stream or sludge that contains from 39% to 76% by weight water, from 23% to 60% by weight dust and from 0.5% to 1% by weight oil as well as trace amounts of arsenic and other metals. When dust laden whole oil is dedusted, the dust laden whole oil is fed to the desalter at a temperature from 100° F. to 250° F. and preferably from 150° F. to 200° F.

with the desalter operated at above atmospheric pressure to minimize vaporization of the water. Where dust laden heavy oil is dedusted, the dust laden heavy oil is fed to the desalter at a temperature from 240° F. to 350° F. and at a viscosity of 2 centistokes to 5 centistokes with the desalter operated at a pressure from 25 psia to 135 psia to mimimize vaporization of the water.

The purified stream of oil can be further dedusted in a second desalter, after from 2% to 7% and preferably from 3% to 5% by volume water is dispersed with and mixed with the purified stream to form a second emulsion. In the second desalter, the second emulsion is separated into a second purified (dedusted) stream of oil containing 15 ppm (0.0015%) to 1500 ppm (0.15%) and preferably about 100 ppm (0.01%) by weight dust leaving a stream of water that has a much lower concentration of dust than the dust laden residual stream of water discharged from the first desalter. The effluent stream of water from the second desalter is recycled upstream of the first desalter for use in emulsifying the influent dust laden oil.

The second stream of oil can be further dedusted in a third desalter, after from 2% to 7% and preferably from 3% to 5% by volume water is dispersed in and mixed with the second purified stream to form a third emulsion. In the third desalter, the third emulsion is separated into a third purified (dedusted) stream of oil containing 15 ppm (0.0015%) to 150 ppm by weight dust leaving a residual stream of water that has a lower concentration of dust than the effluent residual stream of water from the second desalter. The residual stream of water from the third desalter is recycled upstream of the second desalter for use in emulsifying the second purified stream of oil.

The desalters can be electrical or chemical desalters and are each preceded by a mixing valve or emulsifier valve that disperses the water in the oil into enormous quantities of minute droplets from 0.00005 to 0.0005 inches in diameter to greatly increase the surface area so as to promote dedusting. The desalters lower the dust content of the oil by stripping the oil from the dust, entraining the dust in water droplets and dropping the entrained dust as heavy clusters through the water layer to the bottom of the desalter. An emulsifier or surfactant such as a hydrophilic or wetting agent can be added to the dust laden oil to facilitate dedusting. An alkali such as caustic or soda ash, typically sodium hydroxide, can be added to the water to enhance dedusting, keep the water basic and minimize amine absorption.

The desalter sludge from the first desalter can be combusted in the lift pipe leaving a hot spent stream for use as solid heat carrier material in the retort.

Alternatively, the desalter sludge can be separated in a centrifuge or rotary filter into a dedusted stream of water and a centrifuge sludge having a higher concentration of dust than the influent desalter sludge. The dedusted stream of water can be recirculated upstream of any one of the desalters to help emulsify the oil. A flushing agent such as light oil derived from the solid hydrocarbon-containing material can be injected into the centrifuge to wash the centrifuge sludge out of the centrifuge. Desirably, the centrifuge sludge along with the flushing agent is heated, dried and separated in a dryer, such as a screw conveyor dryer, into a purified (dedusted) stream of oil with less than 2% to 5% by weight dust leaving a powdery, dust-enriched residual stream with less than 10% and preferably from 3% to 8% by weight oil. When heavy oil is dedusted, the temperature of the dryer can be controlled to coke, thermal crack and upgrade the heavy oil, into lighter hydrocarbons, mainly, light oil and middle oil. The powdery, dust-enriched residual stream can be combusted in the lift pipe to leave a hot spent stream for use as solid heat carrier material in both the dryer and retort.

As used in this application, the term "dust" means particulates derived from solid hydrocarbon-containing material and ranging in size from less than 1 micron to 1000 microns. The particulates can include retorted and raw, unretorted hydrocarbon-containing material, as well as spend hydrocarbon-containing material or sand if the latter are used as solid heat carrier material during retorting. Dust derived from the retorting of oil shale consists primarily of calcium, magnesium oxides, carbonates, silicates and silicas. Dust derived from the retorting or extraction of tar sand consists primarily of silicates, silicas and carbonates. Dust derived from the retorting, carbonization or gasification of coal consists primarily of char and ash.

The term "desalter" as used herein means an apparatus which is conventionally used for desalting petroleum (crude oil), but which is specifically used in this invention to dedust oil derived from solid hydrocarbon-containing material.

The term "spent" residual stream as used herein means a dusty residual stream derived directly or indirectly via a centrifuge or filter followed by a dryer, in which most, if not all, of the oil and carbon residue contained therein has been removed by combustion.

The term "retorted" hydrocarbon-containing material or "retorted" shale as used in this application refers to hydrocarbon-containing material or oil shale, respectively, which has been retorted to liberate hydrocarbons leaving an organic material containing carbon residue.

The term "spent" hydrocarbon-containing material or "spent" shale as used herein means retorted hydrocarbon-containing material or shale, respectively, from which all of the carbon residue has been removed by combustion.

The terms "normally liquid," "normally gaseous," "condensible," "condensed," or "noncondensible" are relative to the condition of the subject material at a temperature of 77° F. (25° C.) at atmospheric pressure.

A more detailed explanation of the invention is provided in the following description and appended claims taken in conjunction with the accompnying drawings.

DETAILED DESCRIPTION OF THE PREFERRED EMBODIMENTS

Figures 1, 4:
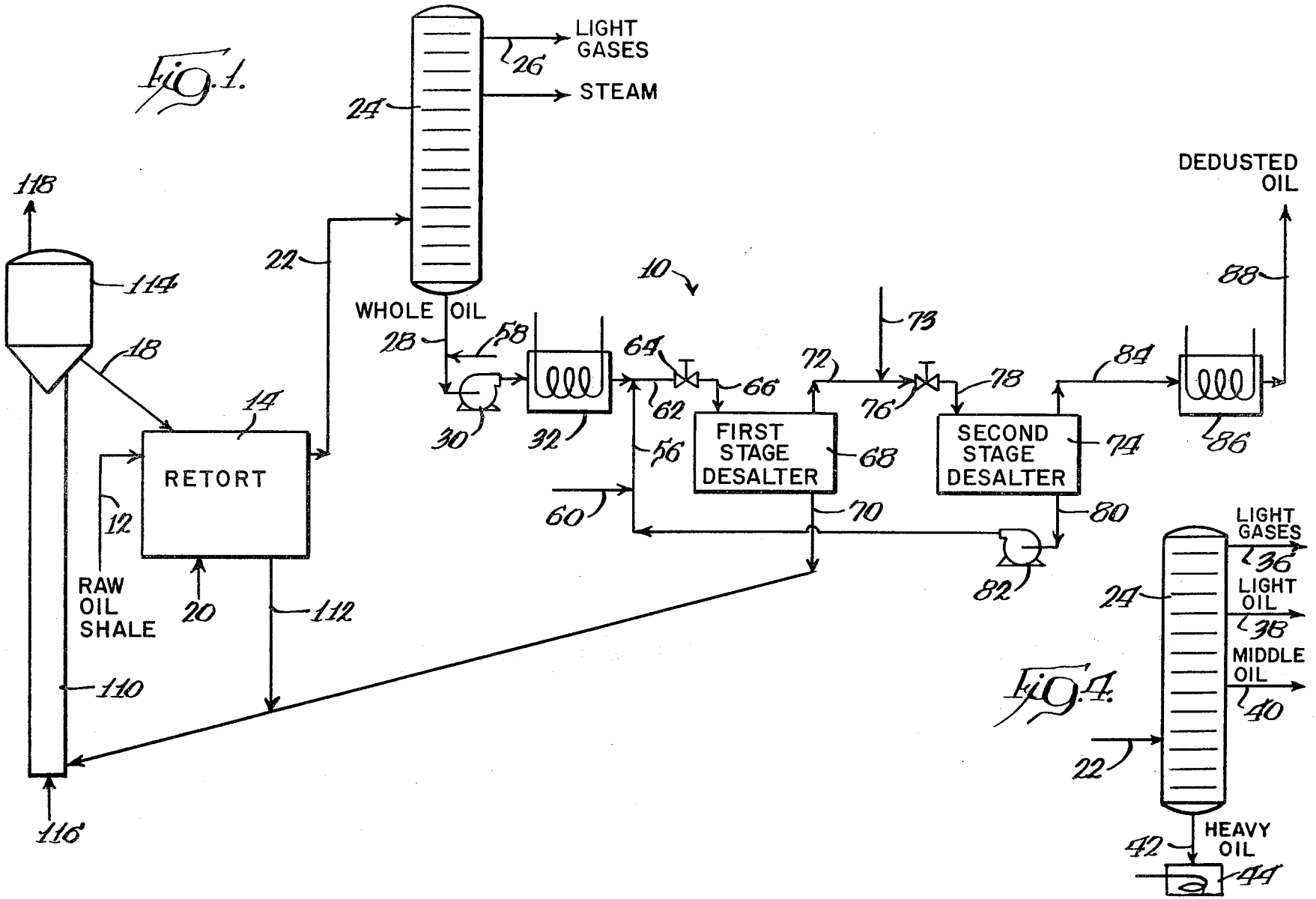
FIG. 1 is a schematic flow diagram of a process in accordance with principles of the present invention.
FIG. 4 (on the same sheet as FIG. 1) is a further alternative embodiment of part of the process of FIG. 1.

Referring now to FIG. 1, a multiple stage desalting and dedusting process and system 10 is provided to dedust dust laden oil derived from solid hydrocarbon-containing material, such as oil shale, coal, tar sand, uintaite (gilsonite), lignite, and peat, into purified streams of oil for use in making synthetic fuels. While the processes of the present invention are described hereinafter with particular reference to the processing of oil shale, it will be apparent that the processes can also be used in connection with the processing of other hydrocarbon-containing materials, such as coal, tar sand, uintaite (gilsonite), lignite, peat, etc.

In process and system 10, raw fresh oil shale, which preferably contains an oil yield of at least 15 gallons per ton of shale particles, is crushed in size to a maximum fluidizable size of 10 mm and fed through a raw shale inlet line 12 at a temperature from ambient temperature to 600° F. into a fluid bed retort 14, also referred to as a "fluidized bed retort." The fresh oil shale can be crushed by conventional crushing equipment, such as an impact crusher, jaw crusher, gyratory crusher or roll crusher, and screened with conventional screening equipment, such as a shaker screen or a vibrating screen.

Spent oil shale and spent residual stream, which together provide a solid heat carrier material, are fed through heat carrier line 18 at a temperature from 1000° F. to 1400° F., preferably from 1200° F. to 1300° F., into retort 14 to mix with, heat and retort raw oil shale in retort 14. A fluidizing gas such as light hydrocarbon gases or other gases which do not contain an amount of molecular oxygen sufficient to support combustion, is injected into the bottom of retort 14 through a gas injector 20 to fluidize, entrain and enhance mixing of the raw oil shale and solid heat carrier material in retort 14. The retorting temperature of retort 14 is from 850° F. to 1000° F., preferably from 900° F. to 960° F. at atmospheric pressure.

During retorting, hydrocarbons are liberated from the raw oil shale as a gas, vapor, mist, or liquid droplets and most likely a mixture thereof, along with entrained particulates of oil shale dust ranging in size from less than 1 micron to 1000 microns.

The mixture of liberated hydrocarbons and entrained particulates are discharged from the upper portion of retort 14 through an outlet line 22 and conveyed to a separator 24, such as a quench tower that is sprayed with light oil or water or a fractionating column. The effluent product stream of liberated hydrocarbons and entrained particulates are separated in separator 24 into fractions of light gases and normally liquid whole shale oil containing from 10% to 15% by weight entrained particulates of shale dust. Whole shale oil consists of heavy shale oil, middle shale oil and light shale oil. Heavy shale oil has a boiling point over 600° F. to 800° F. Middle shale oil has a boiling point over 400° F. to 500° F. and light shale oil has a boiling point over 100° F.

The fraction of shale oil laden with dust, also referred to as a "particulate laden shale oil fraction" or a "dust laden shale oil fraction" is withdrawn from separator 24 by pump 30 and cooled in a heat exchanger or cooler 32 to a temperature from 100° F. to 250° F. and preferably from 150° to 200° F.

Alternatively, the effluent product stream can be separated in separator 34 (FIG. 2) into fractions of light gases, light shale oil, middle shale oil and heavy shale oil with the heavy shale oil containing essentially all the shale dust. Light gases, light shale oil, middle shale oil and heavy shale oil are withdrawn from separator 34 through light gas line 36, light oil line 38, middle oil line 40 and heavy oil line 42, respectively. The heavy shale oil laden with shale dust and the middle shale oil are cooled in heat exchangers or coolers 44 and 46, respectively, and mixed with light shale oil to form a whole shale oil having 10% to 15% by weight shale dust in whole shale oil line 48. The temperature of coolers 44 and 46 are controlled so that the temperature of the whole oil in whole shale oil line 48 is from 100° F. to 250° F. and preferably from 150° F. to 200° F.

Figure 3:
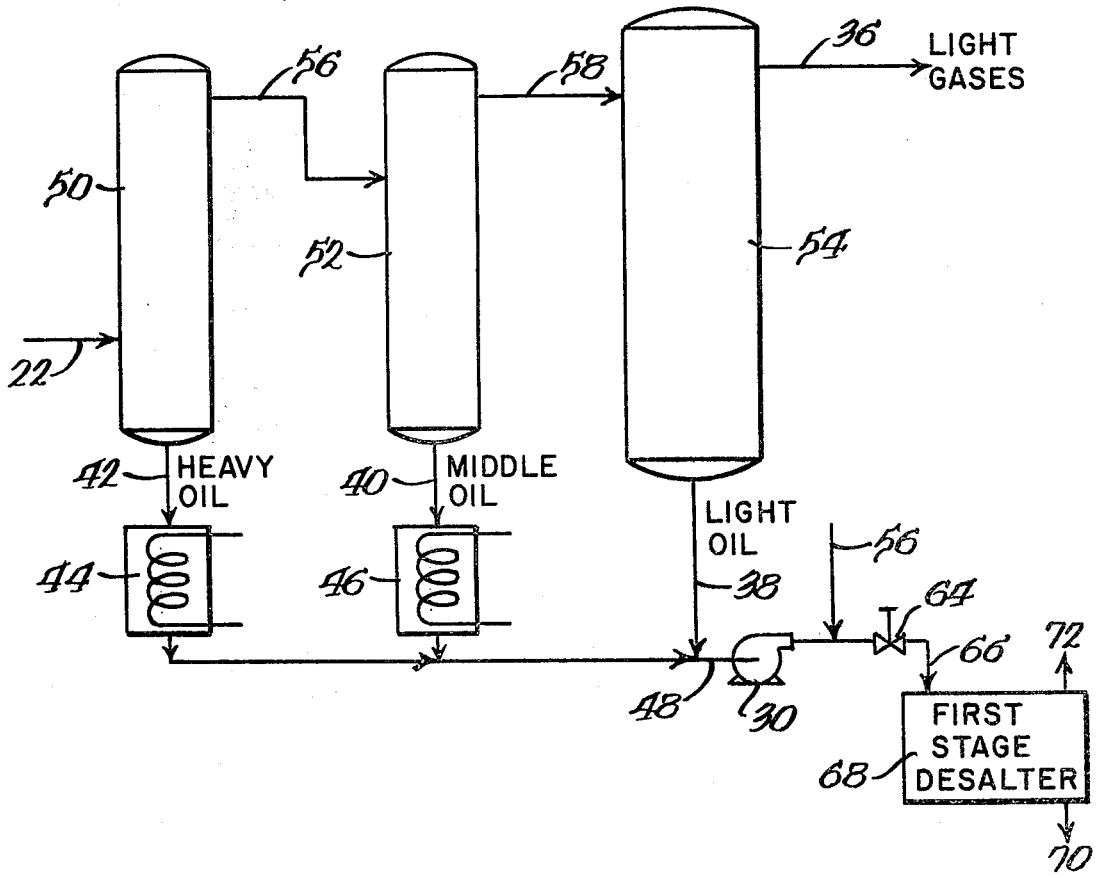
FIG. 3 is another alternative embodiment of part of the process of FIG. 1.

The effluent product stream can also be separated into fractions of light gases, light shale oil, middle shale oil and heavy shale oil in a multiple stage separator such as quench towers 50, 52 and 54 shown in FIG. 3. As shown in FIG. 3, the effluent product stream is separated in a first quench tower or scrubbing tower 50 into a heavy shale oil fraction containing essentially all the shale dust and a first separated stream of hydrocarbons. The heavy shale oil fraction is withdrawn from the bottom of the first quench tower 50 through heavy shale oil line 42 and cooled in heat exchanger or cooler 44. The first separated stream of hydrocarbons is withdrawn from an upper portion of the first quench tower 50 and fed to a second quench tower or scrubbing cooler 52 where it is separated into a middle shale oil fraction and a second separated stream of hydrocarbons. The middle shale oil fraction is withdrawn from the bottom of the second quench tower 52 through middle oil line 40 and cooled in a heat exchanger or cooler 46. The second separated stream of hydrocarbons is fed to a third quench tower or cooling tower 54 where it is separated into fractions of light gases and light oil. The light gases are withdrawn from an upper portion of cooling tower 54 through light gas line 36. Light oil is withdrawn from the bottom of cooling tower 54 through light oil line 38 and combined with the heavy shale oil and middle shale oil to form whole shale oil having 10% to 15% by weight shale dust in line 48. The temperatures of coolers 44 and 46 are controlled so that the temperature of the whole oil in line 48 is from 100° F. to 250° F. and preferably from 150° F. to 200° F.

Figure 2:
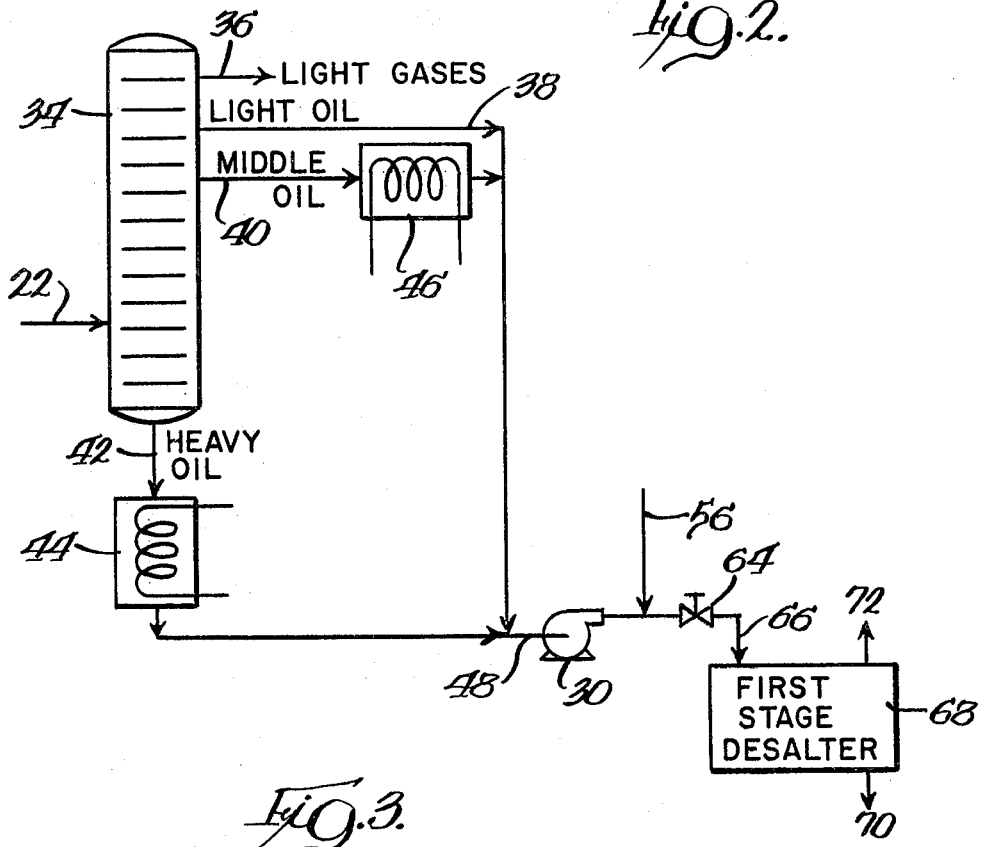
FIG. 2 is an alternative embodiment of part of the process of FIG. 1.

Alternatively, the effluent product stream can be separated in a single-stage quench tower or fractionating column 24 shown in FIG. 4 (on the same sheet as FIG. 1) into fractions of light gases, light shale oil, middle shale oil and heavy shale oil in a manner similar to that described with respect to FIG. 2, except that only heavy shale oil is dedusted and used as a feed stock in the process and system of this invention. The heavy shale oil fraction is a slurry recovered at the bottom of separator 24 that contains from 15% to 35% by weight of the effluent product stream and has from1% to 50% by weight and preferably at least 25% by weight entrained particulates of oil shale dust. The temperature in separator 24 is varied from 500° F. to 800° F. and preferably to a maximum temperature of 600° F. at atmospheric pressure to assure that essentially all the shale dust gravitate to and are entrained in the heavy shale oil fraction. The heavy shale oil fraction is withdrawn from the bottom of separator 24 through heavy oil line 42 and cooled in a heat exchanger or cooler 44 from 240° F. to 350° F. to attain a viscosity from 2 centistokes to 5 centistokes.

As used hereinafter, except where otherwise specified, the term "shale oil" means "whole" shale oil when whole shale oil is dedusted in the processes and systems of this invention and means "heavy" shale oil when only heavy shale oil is dedusted in the processes and systems of this invention.

After the dust laden shale oil has been withdrawn from the separator and cooled, water injector line 56 (FIG. 1) injects from 10% to 50% and preferably a maximum of 30% by volume water in the dust laden shale oil to form an emulsion. An emulsifier or surfactant such as a hydrophilic or wetting agent can be added to the dust laden shale oil before pump 30 through additive line 58 to lower surface tension and enhance dedusting. An alkali such as caustic or soda ash, can be added to the water in line 56 through alkali injector 60 at a rate from 0.01 pounds to 5 pounds of alkali per 1000 barrels of water to keep the water basic so as not to absorb amines and nitrogen and to facilitate emulsion, separation and dedusting as well as to enhance removal of trace metals from the shale oil.

The emulsion of shale oil and water flows through emulsion line 62 to a mixing valve or emulsifier valve 64 where it is discharged through a coalescer line 66 into a first desalter 68. Alternatively, the emulsion can flow from coalescer line 66 to an enlarged diameter pipe, zig-zag shaped coalescing section 69 (FIG. 6) and second coalescer line 70 to further resolve the emulsion before it enters first desalter 68. The solids residence time in coalescer 69 is about 35 minutes.

Figure 5:
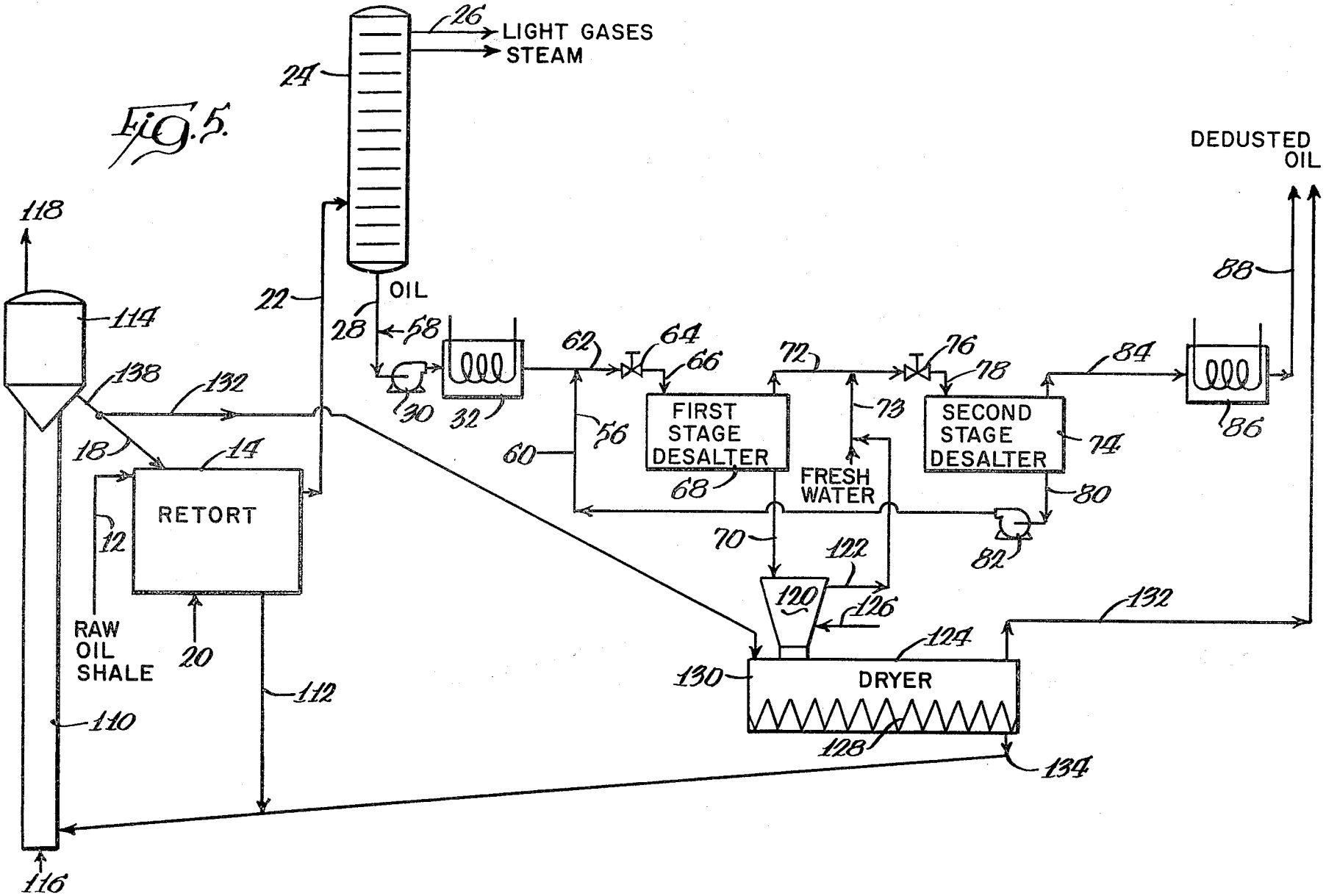
FIG. 5 is a schematic flow diagram of an alternative embodiment of the process of FIG. 1.
Figures 6, 10:
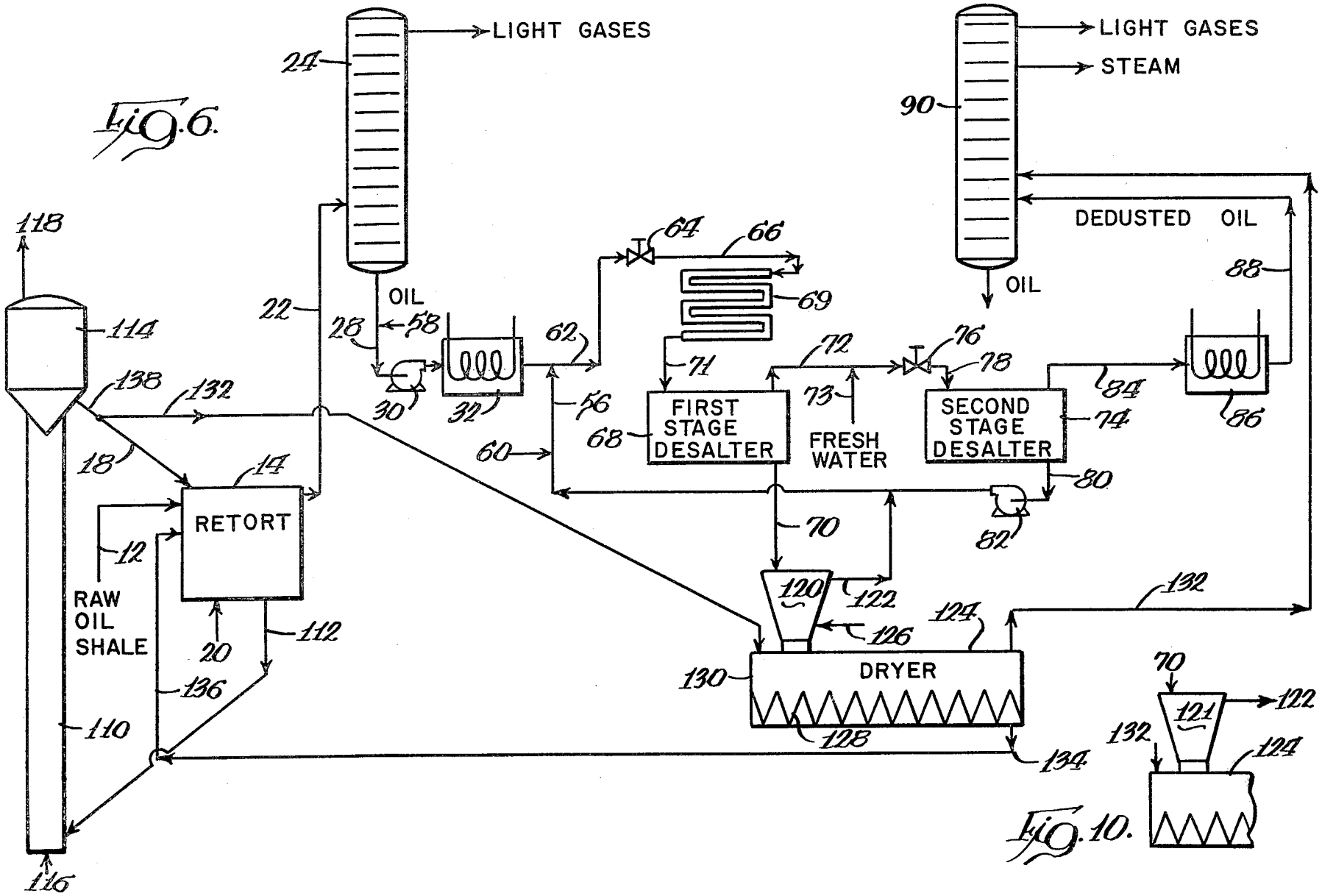
FIG. 6 is a schematic flow diagram of another alternative embodiment of the process of FIG. 1.
FIG. 10 (on the same sheet as FIG. 6) is an alternative embodiment of part of the processes of FIGS. 5–9.
Figure 7:
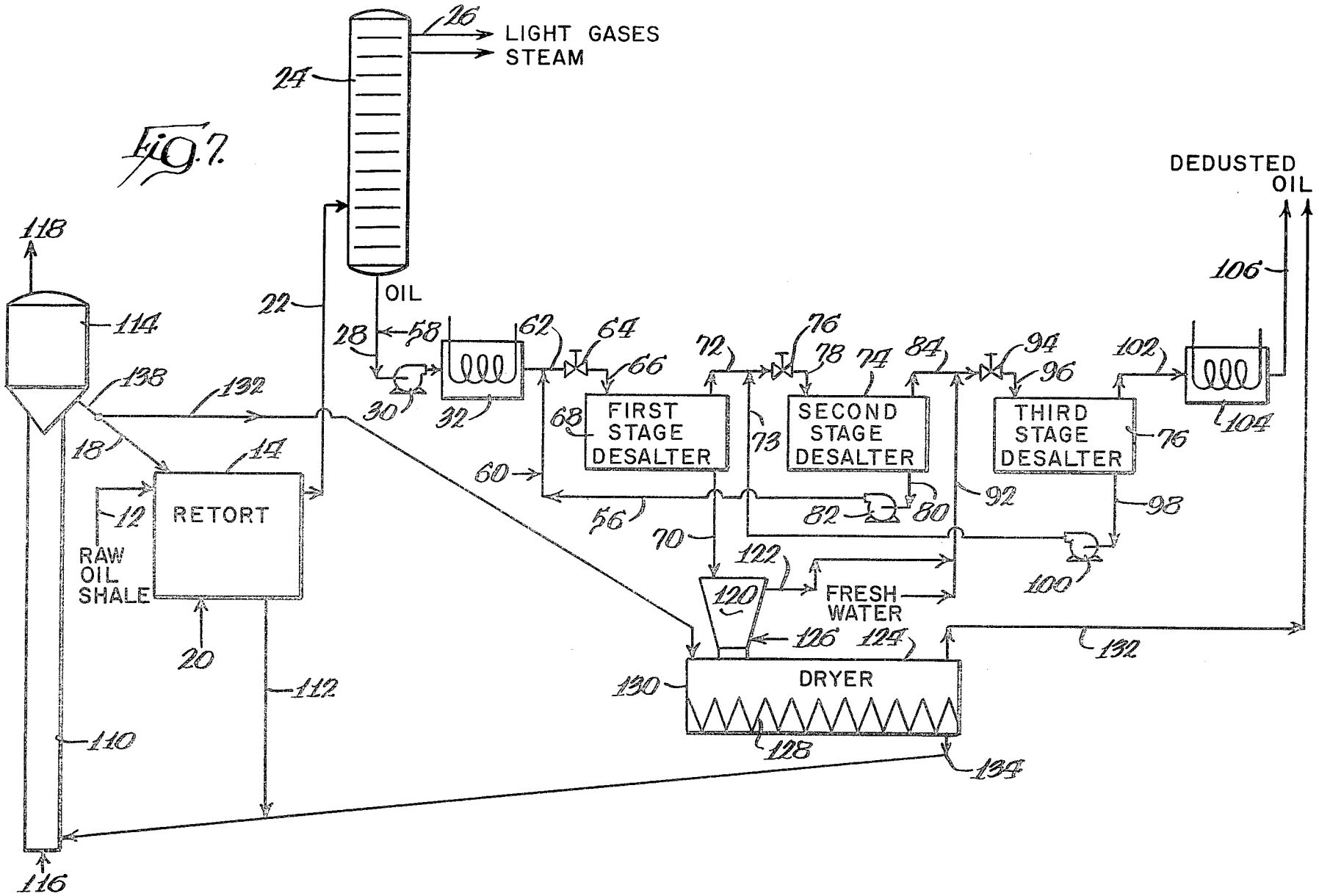
FIG. 7 is a schematic flow diagram of another process in accordance with principles of the present invention.
Figures 8, 9:
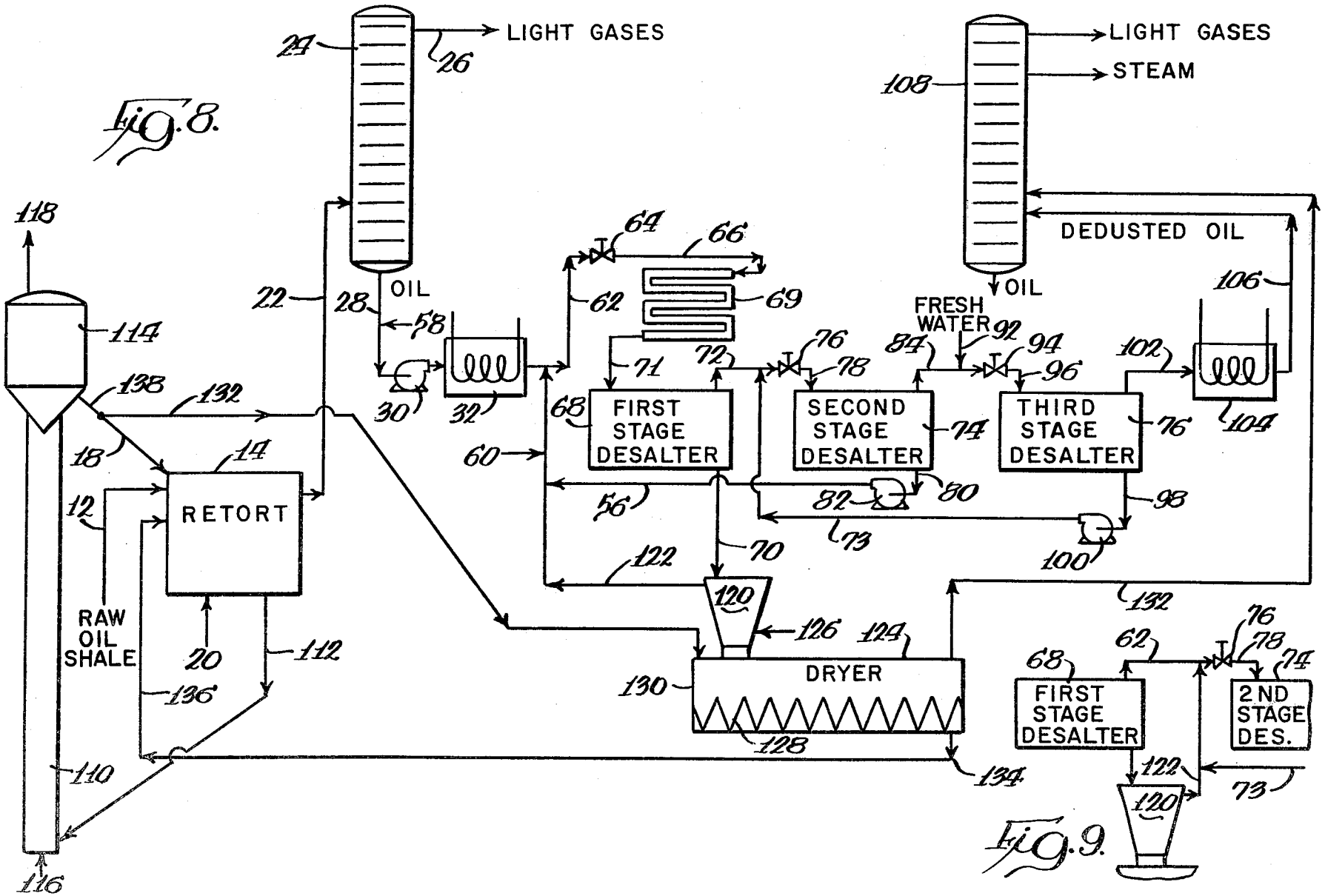
FIG. 8 is a schematic flow diagram of an alternative embodiment of the process of FIG. 7.
FIG. 9 is an alternative embodiment of part of the process of FIG. 7.

First desalter 68 is positoned upstream and in series with a second desalter 74 as shown in FIGS. 1 and 5-9. Second desalter 74 can also be positioned upstream and in series with a third desalter 76 as shown in FIGS. 7 and 8. Desalters 68, 74, and 76 can be electrical desalters or chemical desalters. The residence time in desalters 68, 74, and 76 is from 0.5 minutes to 25 minutes and preferably from 6 minutes to 12 minutes. The pressure in desalters 68, 74 and 76 is about atmospheric pressure when whole shale oil is dedusted and from 25 psia to 135 psia when heavy shale oil is dedusted, in order to minimize vaporization of the water and oil.

First desalter 68 breaks up and separates the first emulsion into a first purified, dedusted phase or stream of normally liquid shale oil containing from 1500 ppm (0.15%) to 15,000 ppm (1.5%) by weight shale dust and a particulate laden aqueous phase or water stream, also referred to as "first desalter sludge." First desalter 68 is also effective in removing significant amounts of arsenic and other trace metals from the influent dust laden shale oil.

The desalter sludge is removed from the bottom of first desalter 68 through sludge line 70 and contains from 39% to 76% and preferably 65% by weight water, from 23% to 60% and preferably 34-$\frac{1}{3}$% by weight shale dust and from 0.5% to 1% and preferably 0.66% shale oil as well as from 0.01% to 0.1% by weight arsenic and other trace metals.

The effluent stream of oil is withdrawn from first desalter 68 through outlet line 62 and is injected with 2% to 7% and preferably from 3% to 5% by volume water from second water injector line 74 to form a second emulsion. The second emulsion flows through a second mixing valve or emulsifier valve 76 and then through coalescer line 78 into a second desalter 74.

Second desalter 74 breaks up and separates the second emulsion into a second purified, dedusted phase or stream of normally liquid shale oil with less than 15 ppm (0.0015%) to 1500 ppm (0.15%) and preferably about 100 ppm (0.01%) by weight shale dust and a second aqueous phase or stream of water having a substantially lower concentration of shale dust than the first desalter sludge. The second stream of water is pumped out of the bottom of second desalter 74 through water outlet line 80 by pump 82 and recycled through water recirculation line 56 upstream of first mixing valve 64 for dispersion into the influent dust laden oil.

The second stream of shale oil is withdrawn from second desalter 74 through second outlet line 84 and passed through a heat exchanger or cooler 86 (FIGS. 1 and 5) for further processing and upgrading. In FIG. 6, the second stream of shale oil is passed through a heat exchanger or cooler 86 and fed to another separator 90 before further processing and upgrading.

When the second stream of shale oil has a dust concentration over 150 ppm, such as when it is near the 1500 ppm upper end of the dust concentration range, the second stream of shale oil can be further dedusted in a third desalter 76 (FIGS. 7 and 8). In that case, the second stream of shale oil is withdrawn from second desalter 74 through second outlet line 84 and injected with 2% to 7% and preferably from 3% to 5% by volume water from third water injector line 92 to form a third emulsion. The third emulsion flows through a third mixing valve or emulsifier valve 94 and then through coalescer line 96 into third desalter 76. Third desalter 76 breaks up and separates the third emulsion into a highly purified, dedusted phase or stream of normally liquid shale oil having from 15 ppm (0.0015%) to 150 ppm (0.0150%) by weight shale dust and a third aqueous phase or stream of water having a lower concentration of dust than the second stream of water from the second desalter 68. The third stream of water is pumped out of the bottom of third desalter 76 through third water outlet line 98 by pump 100 and recycled through second water recirculation line 73 upstream of second mixing valve 76 for dispersion into the first effluent stream of oil.

The highly dedusted, third purified stream of shale oil is withdrawn from third desalter 76 through third outlet line 102 (FIG. 7) and passed through a heat exchanger or cooler 104 for further processing and upgrading. In FIG. 8, the highly dedusted stream of oil from the third desalter 76 is passed through a heat exchanger or cooler 104 and fed to another separator 108 for further processing and upgrading.

The heat exchangers and coolers described throughout this application can be cooled by light shale oil, middle shale oil, steam or water from the separators. Other cooling media can also be used.

Desalter sludge from the first desalter 68 can be discharged through sludge line 70 and conveyed directly to the bottom portion of a vertical lift pipe 110 as shown in FIG. 1 by conveying means, such as a vibrating solid conveyor, pneumatic conveyor or screw conveyor. In FIG. 1, retorted shale and solid heat carrier material from retort 14 are discharged from the bottom of retort 14 into discharge line 112 where they are fed and mixed with desalter sludge in sludge line 70. Alternatively, the first desalter sludge can be fed to lift pipe 110 via retort 14.

In lift pipe 110 (FIG. 1), desalter sludge, retorted shale and heat carrier material are fluidized, entrained, propelled and conveyed upwardly into a collection and separation bin 114, also referred to as a "collector," by air injected into the bottom of lift pipe 110 through air injector nozzle 116. Shale oil residue in the desalter sludge and carbon residue in the retorted shale are combusted in lift pipe 110 to heat the fluidized material to a temperature from 1000° F. to 1400° F. and preferably from 1200° F. to 1300° F. The combusted desalter sludge and combusted retorted shale form a hot spent residual stream and hot spent oil shale, respectively, for use as solid heat carrier material in retort 14.

Spent material is discharged from the bottom of separation bin 114 through heat carrier line 18 into retort 14. Combustion gases are withdrawn from the top of separation bin 114 through combustion gas line 118 and dedusted in a cyclone or electrostatic precipitator for discharge into the atmosphere or further processing.

In FIGS. 5–9, desalter sludge is discharged from the bottom of first desalter 68 through sludge line 70 into a centrifuge 120, where it is centrifuged from 2000 rpm to 4000 rpm and preferably at 2500 rpm at a pressure to minimize vaporization of the residual oil in the sludge. Centrifuge 120 separates the desalter sludge into a purified, dedusted stream of water and a dewatered, dust laden residual stream, also referred to as "centrifuge sludge." In some circumstances it may be desirable to use a rotary filter or rotating filter 121 (FIG. 10 on the same sheet as FIG. 6) instead of centrifuge 120. Dedusted water is clear clarified water, also referred to as a "centrate," with less than 0.5% and preferably less than 0.25% by weight shale dust. Dedusted water is withdrawn from the upper portion of centrifuge 122 through dedusted water line 122 and recycled to any of the water injector lines 60, 73 or 92. For example, in FIGS. 6 and 8, dedusted water is recycled to first water injector line 56. In FIGS. 5 and 9, dedusted water is recycled to second water injector line 73. In FIG. 7, dedusted water is recycled to third water injector line 92.

The centrifuge sludge is a cake, residue, or sediment that contains from 60% to 80% and preferably 70% by weight shale dust with the remainder being residual water, shale oil residue, arsenic and other trace metals. In FIGS. 5–8, centrifuge sludge is discharged from centrifuge 120 into a screw conveyor dryer or heater 124. Light shale oil from separator 24 can be injected into centrifuge 120 through light oil injection line 126 to flush and wash out the sticky sludge from the bottom of centrifuge 120 into screw conveyor dryer 124.

Spent oil shale and spent residual stream, which together provide solid heat carrier material and the source of heat for dryer 38, are fed together through heat carrier line 132 into dryer 124 at a temperature from 800° F. to 1400° F. and preferably at about 1200° F. The solid feed rate ratio of centrifuge sludge to heat carrier material fed to dryer 124 is from 2:1 to 7:1 and preferably from 3:1 to 5:1.

Screw conveyor dryer 124 has twin horizontal mixing screws 128 and an overhead vapor collection hood 130 which provides a dust settling and disentrainment space. Screws 128 operate in the range from 10 rpm to 100 rpm and preferably from 20 rpm to 30 rpm. Dryer 124 operates at a pressure from a few inches water vacuum (−5 inches $H_2O$ or −0.18 psig) to 150 psig and preferably at atmospheric pressure. A screw conveyor dryer with a single screw or a fluid bed dryer can also be used.

In dryer 124, the centrifuge sludge flushed with light oil is mixed with heat carrier material at a heating temperature from 400° F. to 950° F., preferably from 700° F. to 900° F. and most preferably about 900° F., until it is heated, dried and separated into a powdery, dust-enriched residual stream and a purified, dedusted stream of normally liquid shale oil, including light shale oil and steam with less than 5% and preferably less than 2% by weight shale dust. The solids residence time in dryer 124 is from 0.5 minutes to 120 minutes and preferably from 10 minutes to 30 minutes. When only heavy shale oil is dedusted, the heavy shale oil in dryer 124 can be coked, thermal cracked and upgraded into lighter hydrocarbons, mainly, light shale oil and middle shale oil, by controlliing the heating temperature in dryer 124.

The dedusted stream of shale oil from dryer 124 is discharged through overhead line 132 and fed to separator 24 for further processing and upgrading. Alternatively, the purified stream of oil shale from dryer 124 can be fed to another separator 90 (FIG. 6) or 108 (FIG. 8) for further processing and upgrading. In some circumstances, it may be desirable to further process and upgrade the dedusted stream of shale oil from the dryer without first passing the shale oil through a separator.

The powdery, dust-enriched residual stream from dryer 124 has less than 10% and preferably from 3% to 8% by weight normally liquid shale oil and a higher concentration of shale dust than the centrifuge sludge. The powdery, dust-enriched residual stream and the solid heat carrier material in dryer 124 are discharged from the bottom of dryer 124 through residue outlet line 134 and conveyed directly to the bottom portion of lift pipe 110 as shown in FIGS. 5 and 7 by conveying means, such as a vibrating solid conveyor, pneumatic conveyor or screw conveyor, or indirectly thereto via retort 14 thrugh inlet line 136 and discharge line 112 as shown in FIGS. 6 and 8, after being mixed with retorted shale and solid heat carrier material from retort 14.

In lift pipe 110 (FIGS. 5–8), the powdery, dust-enriched residual stream, retorted shale and heat carrier material are fluidized, entrained, propelled and conveyed upwardly into a collection and separation bin 114 by air injected into the bottom of lift pipe 54 through air injector nozzle 116. Shale oil and any carbon residue in the powdery, dust-enriched residual stream and carbon residue in the retorted shale are combusted in lift pipe 110 to heat the fluidized material to a temperature from 1000° F. to 1400° F. and preferably from 1200° F. to 1300° F. The combusted powdery, dust-enriched residual stream and the combusted retorted shale form a hot spent residual stream and hot spent oil shale, respectively, for use as solid heat carrier material in dryer 124 and retort 14.

Spent material is discharged from the bottom of separation bin 11 through heat carrier line 138 (FIGS. 5–8). Part of the heat carrier material in heat carrier line 138 is fed to retort 14 via heat carrier line 18 and part of the heat carrier material in heat carrier line 138 is fed to dryer 124 via heat carrier line 132. Combustion gases are withdrawn from the top of separation bin 114 through combustion gas line 118 and dedusted in a cyclone or electrostatic precipitator for discharge into the atmosphere or further processing.

In the processes and systems of this invention, from 80% to 100% and preferably from 95% to 100% by weight of the shale oil in the separated shale oil fraction is dedusted and recovered as purified streams of oil.

Among the many advantages of the above processes and systems are:

1. Improved product yield.
2. Better dedusting of shale oil.
3. Lower product viscosity.
4. Ability to pipeline the dedusted shale oil through valves, outlet orifices, heat exchangers, pumps and distillation towers and refine the dedusted shale oil in hydrotreaters and catalytic crackers.
5. Utilization of dust laden sludge and minimization of sludge disposal problems.

While the retort shown in the preferred embodiments is a fluid bed retort, other retorts can be used such as a screw conveyor retort follower by a surge bin or a rotating pyrolysis drum followed by an accumulator. Metal or ceramic balls can also be used as solid heat carrier material with the lift pipe serving as a ball heater. Sand can also be used as heat carrier material.

Although embodiments of this invention have been shown and described, it is to be understood that various modifications and substitutions, as well as rearrangements and combinations of process steps, can be made by those skilled in the art without departing from the novel spirit and scope of this invention.

What is claimed is:

1. A process for producing and dedusting oil from solid hydrocarbon-containing material, comprising the steps of:

feeding solid hydrocarbon-containing material to a retort;

feeding solid heat carrier material to said retort;

retorting said solid hydrocarbon-containing material by mixing said solid hydrocarbon-containing material with said solid heat carrier material in said retort at a sufficient retorting temperature to liberate an effluent product stream of hydrocarbons and entrained particulates of dust derived from said solid hydrocarbon-containing material;

separating a fraction of normally liquid oil mixed with a substantial portion of said entrained particulates from said effluent product stream in a separator;

dispersing water into said fraction after said fraction has been removed from said separator to form an emulsion;

separating said emulsion in a desalter into a dedusted stream of normally liquid oil having a substantially lower concentration of particulates than said fraction and a particulate laden residual stream having a higher concentration of said particulates than said fraction; and combusting said particulate laden residual stream after said particulate laden residual stream has been removed from said desalter to form a spent stream for use as at least part of said solid heat carrier material in said retort.

2. A process in accordance with claim 1 wherein said solid hydrocarbon-containing material is selected from the group consisting of oil shale, tar sand, coal, lignite, peat and uintaite.

3. A process in accordance with claim 1 wherein said particulates are selected from the group consisting of raw, retorted and spent hydrocarbon-containing material.

4. A process in accordance with claim 1 wherein said particulates are selected from the group consisting of calcium, magnesium oxides, carbonates, silicates, char and ash.

5. A process in accordance with claim 1 wherein said stream of oil is further dedusted in at least one other desalter.

6. A process in accordance with claim 1 wherein said particulate laden residual stream is heated and substantially dried in a dryer before being combusted.

7. A process in accordance with claim 1 wherein said particulate laden residual stream is centrifuged before before being combusted.

8. A process in accordance with claim 1 wherein said particulate laden residual stream is filtered in a rotary filter before being combusted.

9. A process in accordance with claim 1 wherein said oil is said dedusted stream and said fraction is whole oil consisting essentially of normally liquid heavy oil, normally liquid middle oil and normally liquid light oil.

10. A process in accordance with claim 1 wherein said oil in said dedusted stream and said fraction consists essentially of normally liquid heavy oil.

11. A process for dedusting oil derived from solid hydrocarbon-containing material, comprising heating whole oil selected from the group consisting of shale oil, tar sands oil, coal oil, lignite oil, peat oil and uintaite oil, to a viscosity ranging from 2 centistokes to 5 centistokes and thereafter removing a substantial amount of particulates ranging in size from less than 1 micron to 1000 microns selected from the group consisting of oil shale particulates, tar sands particulates, coal ash particulates, lignite particulates, peat particulates and unitaite particulates from said heated whole oil in a plurality of desalters connected in series with each other by emulsifying said heated whole oil with water upstream of each desalter and separating said emulsion in each desalter into a dedusted oil phase and a dust-enriched aqueous phase, removing said dust-enriched aqueous phase from the first desalter, combusting said removed dust-enriched aqueous phase to form a spent stream, and feeding said spent stream to a surface retort for use as solid heat carrier material in retorting raw solid hydrocarbon containing material to liberate said whole oil.

12. A process in accordance with claim 11 wherein said heated whole oil is passed through a series of chemical desalters.

13. A process for dedusting shale oil, comprising the steps of:

(a) mixing from 10% to 50% by volume water with shale oil laden with shale particulates ranging in size from less than 1 micron to 1000 microns to form a first emulsion;

(b) separating said first emulsion in a first desalter into a first dedusted stream of shale oil containing from 0.15% to 1.5% by weight shale particulates and a first stream of water containing from 23% to 60% by weight shale particulates and from 0.5% to 1% by weight shale oil;

(c) removing said first dedusted stream of shale oil from said first desalter;

(d) mixing from 2% to 7% by volume water with said removed first dedusted stream to form a second emulsion;

(e) separating said second emulsion in a second desalter into a second dedusted stream of shale oil containing from 0.0015% to 0.15% by weight shale particulates and a second stream of water containing a substantially lower concentration of shale particulates than said first stream of water;

(f) centrifuging said first stream of water into a purified stream of water and a centrifuge sludge having a higher concentration of shale particulates than said first stream of water;

(g) recirculating said purified stream of water for use in step (a) or (d);

(h) mixing said centrifuge sludge with solid heat carrier material in a dryer at a sufficient drying temperature to separate said centrifuge sludge into a third dedusted stream consisting of normally liquid shale oil and less than 5% by weight shale dust and a residual stream consisting of less than 10% by weight normally liquid shale oil and a higher concentration of shale dust than said centrifuge sludge;

(i) combusting said residual stream in a lift pipe to form a spent stream; and (j) using said spent stream as part of said solid heat carrier material in said dryer.

14. A process in accordance with claim 13 wherein said third dedusted stream of normally liquid shale oil has less than 2% by weight shale dust and said residual stream has from 3% to 8% by weight normally liquid shale oil.

15. A process in accordance with claim 13 wherein said desalters are chemical desalters and an emulsifier is added to said shale oil in step (a) before said water is mixed with said shale oil.

16. A process in accordance with claim 13 wherein said first emulsion is fed through a coalescer upstream of said first desalter.

17. A process in accordance with claim 13 wherein said desalters are electrical desalters and a surfactant containing a wetting agent is injected into said shale oil in step (a) before said water is mixed with said shale oil.

18. A process in accordance with claim 13 wherein:

said shale oil in steps (a), (b), (c) and (e) consists of normally liquid heavy shale oil having a boiling point over 600° F;

said heavy shale oil in step (a) has from 25% to 50% by weight shale particulates;

said heavy shale oil in step (a) is heated to a viscosity ranging from 2 centistokes to 5 centistokes before water is added; and said first emulsion is separated in said first desalter at a pressure from 25 psia to 35 pisa to minimize vaporization of water in said first desalter.

19. A process in accordance with claim 13 wherein:

said shale oil in steps (a), (b), (c) and (e) is normally liquid whole shale oil consisting of normally liquid heavy shale oil having a boiling point over 600° F., normally liquid middle shale oil having a boiling point over 400° F. and normally light oil having a boiling point over 100° F.;

said whole shale oil in step (a) has from 10% to 15% by weight shale particulates;

said whole shale oil in step (a) is cooled to a temperature from 100° F. to 250° F. before said water is mixed with said shale oil; and said first emulsion is separated in said first desalter at about atmospheric pressure to minimize vaporization of water in said first desalter.

20. A process in accordance with claim 19 wherein said shale oil in step (a) is cooled to a temperature from 150° F. to 200° F. before said water is mixed with said shale oil.

21. A process in accordance with claim 13 wherein each of said first and second desalters are both operated at a pressure to minimize vaporization of water in each of said desalters.

22. A process in accordance with claim 13 wherein:

said second dedusted stream is removed from said second desalter;

from 2 percent to 7 percent by volume of water is mixed with said removed second dedusted stream in an emulsifier valve to form a third emulsion; and said third emulsion is separated in a third desalter into a third purified stream of normally liquid shale oil containing from 0.0015 percent to 0.0150 percent by weight shale dust and a third stream of water.

23. A process for dedusting shale oil, comprising the steps of:

(a) mixing from 10% to 50% by volume water with shale oil laden with shale particulates ranging in size from less than 1 micron to 1000 microns to form a first emulsion;

(b) separating said first emulsion in a first desalter into a first dedusted stream of shale oil containing from 0.15% to 1.5% by weight shale particulates and a first stream of water containing from 23% to 60% by weight shale particulates and from 0.5% to 1% by weight shale oil;

(c) removing said first dedusted stream of shale oil from said first desalter;

(d) mixing from 2% to 7% by volume water with said removed first dedusted stream to form a second emulsion;

(e) removing said second dedusted stream of shale oil from said second desalter;

(f) mixing from 2% to 7% by volume water with said removed second dedusted stream to form a third emulsion;

(g) separating said third emulsion in a third desalter into a third dedusted stream of shale oil containing from 0.0015% to 0.0150% by weight shale particulates and a third stream of water containing a substantially lower concentration of shale particulates than said second stream of water;

(h) centrifuging said first stream of water into a purified stream of water and a centrifuge sludge having a higher concentration of shale particulates than said first stream of water;

(i) mixing said centrifuge sludge with solid heat carrier material in a dryer at a sufficient drying temperature to separate said centrifuge sludge into a fourth dedusted stream consisting of normally liquid shale oil and less than 5% by weight shale dust and a residual stream consisting of less than 10% by weight normally liquid shale oil and a higher concentration of shale dust than said centrifuge sludge;

(j) combusting said residual stream in a lift pipe to form a spent stream; and (k) using said spent stream as part of said solid heat carrier material in said dryer.

24. A process in accordance with claim 23 wherein said third stream of water from said third desalter is recycled upstream of said second desalter for use in step (d).

25. A process in accordance with claim 23 wherein 3% to 5% by volume water is mixed with said first and second dedusted streams in steps (d) and (g), and a maximum of 30% by volume water is mixed with said shale oil in step (a).

26. A process in accordance with claim 23 wherein said purified stream of water from said centrifuge is recycled and used in step (a).

27. A process in accordance with claim 23 wherein said fourth dedusted stream has less than 2% by weight shale particulates and said residual stream has from 3% to 8% by weight normally liquid shale oil.

28. A process in accordance with claim 23 wherein said shale oil in steps (a), (b), (c), (e), and (g) is heavy shale oil having a boiling point over 600° F.

29. A process in accordance with claim 23 wherein said shale oil in steps (a), (b), (c), (e), and (g) is whole shale oil consisting of normally liquid heavy shale oil having a boiling point over 600° F., normally liquid middle shale oil having a boiling point over 400° F. and normally liquid light oil having a boiling point over 100° F.

30. A process for producing and dedusting shale oil, comprising the steps of:

(a) introducing raw oil shale into a retort;

(b) introducing solid heat carrier material including spent oil shale into said retort;

(c) retorting said raw oil shale in said retort by mixing said raw oil shale and said solid heat carrier material in said retort at a sufficient retorting temperature to liberate an effluent product stream of hydrocarbons and entrained particulates of oil shale dust ranging in size from less than 1 micron to 1000 microns;

(d) separating a particulate laden shale oil fraction from said effluent product stream in a separator.

(e) mixing from 10% to 50% by volume water with said removed particulate laden shale oil fraction to form a first emulsion;

(f) separating said first emulsion in a first desalter into a first dedusted stream consisting of normally liquid shale oil and from 1500 ppm to 15,000 ppm by weight oil shale dust and a first particulate laden water stream consisting of 39% to 76% by weight water, 23% to 60% by weight oil shale dust and 0.5% to 1% by weight normally liquid shale oil;

(g) removing said first dedusted stream from said first desalter;

(h) mixing from 2% to 7% by volume water with said removed first dedusted stream to form a second emulsion;

(i) separating said second emulsion in a second desalter into a second dedusted stream of normally liquid shale oil containing from 15 ppm to 1500 ppm by weight oil shale dust and a second stream of water having a substantially lower concentration of oil shale dust than said first particulate laden water stream; and (j) recycling said second stream of water from said second desalter upstream of said first desalter for use in step (e) without centrifuging said second stream of water; and (k) processing said first stream of water from said first desalter in an apparatus selected from the group consisting of a combustor lift pipe, rotary filter, centrifuge, dryer and combinations thereof, separate and apart from said second stream of water from the second desalter.

31. A process in accordance with claim 30 wherein said desalters are chemical desalters and an emulsifier is added to said particulate laden oil fraction before water is mixed with said fraction.

32. A process in accordance with claim 30 wherein said desalters are electrical desalters and a surfactant containing a wetting agent is injected into said particulate laden oil fraction before said water is mixed with said fraction.

33. A process in accordance with claim 30 wherein:

said particulate laden shale oil fraction consists of normally liquid heavy shale oil having a boiling point over 600° F. and from 1% to 50% by weight shale dust;

said heavy shale oil in said particulate laden shale oil fraction is heated to a viscosity from 2 centistokes to 5 centistokes before water is added to said fraction;

said first emulsion is separated in said first desalter at a pressure from 25 psia to 35 psia to minimize vaporization of water in said first desalter;

said oil in said first and second dedusted streams consists of normally liquid heavy shale oil having a boiling point over 60° F.; and at least 80% by weight of said heavy shale oil in said particulate laden shale oil fraction is dedusted and recovered in said second dedusted stream.

34. A process in accordance with claim 30 wherein:

said particulate laden shale oil fraction consists of normally liquid whole shale oil and from 10% to 15% by weight shale dust, said whole shale oil consisting of normally liquid heavy shale oil having a boiling point over 600° F., normally liquid middle shale oil having a boiling point over 400° F. and normally light oil having a boiling point over 100° F.;

said whole shale oil in said particulate laden shale oil fraction is heated to a temperature ranging from 100° F. to 250° F. before said water is added to said fraction;

said first emulsion is separated in said first desalter at about atmospheric pressure to minimize vaporization of water in said first desalter;

said oil in said first and second dedusted streams consists of said normally liquid whole shale oil; and at least 80% by weight of said whole shale oil in said particulate laden shale oil fraction is dedusted and recovered in said second dedusted stream.

35. A process in accordance with claim 34 wherein said fraction is heated to a temperature ranging from 150° F. to 200° F., said second dedusted stream has a maximum of 100 ppm by weight shale dust and at least 95% by weight of whole shale oil in said particulate laden shale oil fraction is dedusted and recovered in said second dedusted stream.

36. A process in accordance with claim 30 wherein said separator is selected from the group consisting of a fractionator and a quench tower and said second dedusted stream of shale oil from said second desalter is fed to said separator.

37. A process in accodance with claim 30 wherein:

said second dedusted stream is removed from said second desalter;

from 2% to 7% by water volume is mixed with said removed second dedusted stream to form a third emulsion;

said third emulsion is spearated in a third desalter into a third purified stream of normally liquid shale oil containing from 15 ppm to 150 ppm by weight shale dust and a third stream of water; and said third stream of water is recirculated upstream of said second desalter for use in step (h).

38. A process for producing and dedusting shale oil, comprising the steps of:

(a) introducing raw oil shale into a retort;

(b) introducing solid heat carrier material including spent oil shale into said retort;

(c) retorting said raw oil shale in said retort by mixing said raw oil shale and said solid heat carrier material in said retort at a sufficient retorting temperature to liberate an effluent product stream of hydrocarbons and entrained particulates of oil shale dust ranging in size from less than 1 micron to 1000 microns;

(d) separating a particulate laden shale oil fraction consisting of normally liquid shale oil and from 10% to 50% by weight oil shale dust from said effluent product stream;

(e) dispersing 10% to 50% by volume water in said removed particulate laden shale oil fraction to form a first emulsion;

(f) separating said emulsion in a first desalter into a first dedusted stream consisting of normally liquid shale oil and from 1500 ppm to 15,000 ppm by weight oil shale dust and a first particulate laden water stream consisting of 39% to 76% by weight water, 23% to 60% by weight oil shale dust and 0.5% to 1% by weight normally liquid shale oil;

(g) removing said first dedusted stream from said first desalter;

(h) dispersing 2% to 7% by volume water into said removed first dedusted stream from said first desalter to form a second emulsion;

(i) separating said second emulsion in a second desalter into a second dedusted stream of normally liquid shale oil containing from 15 ppm to 1500 ppm by weight oil shale dust and a second stream of water having a substantially lower concentration of oil shale dust than said first particulate laden water stream;

(j) recycling said second stream of water from said second desalter directly upstream of said first desalter without centrifuging said second stream of water for use in step (e);

(k) removing said second dedusted stream from said second desalter;

(l) dispersing 2% to 7% by volume water into said removed second dedusted stream from said second desalter to form a third emulsion;

(m) separating said third emulsion in a third desalter into a third dedusted stream of normally liquid shale oil containing from 15 ppm to 150 ppm by weight oil shale dust and a third stream of water having a substantially lower concentration of oil shale dust than said second stream of water; and (n) recycling said third stream of water from said third desalter upstream of said second desalter for use in step (h).

39. A process in accordance with claim 38 wherein said shale oil in said fraction and said dedusted streams consists essentially of normally liquid heavy shale oil having a boiling point over 600° F.; at least 80% by weight of said heavy shale in said particulate laden shale oil fraction is recovered from said third desalter in said third dedusted stream; and said heavy shale oil in said particulate laden shale oil fraction is heated to a viscosity ranging from 2 centistrokes to 5 centistokes.

40. A process in accordance with claim 38 wherein said shale oil in said fraction consists of normally liquid whole shale oil and said whole shale oil consists of normally liquid heavy shale oil having a boiling point over 600° F., normally liquid middle shale oil having a boiling point over 400° F. and normally liquid light oil having a boiling point over 100° F.; at least 80% by weight of said whole shale oil in said particulate laden shale oil fraction is recovered from said third desalter in said third dedusted stream; and said whole shale oil in said particulate laden shale oil fraction is cooled to a temperature ranging from 100° F. to 250° F. before step (e).

41. A process in accordance with claim 40 wherein at least 95% by weight of said normally liquid whole shale oil in said particulate laden shale oil fraction is dedusted and recovered from said third desalter in said third dedusted stream and said whole oil in said particulate laden shale oil fraction is cooled to a temperature ranging from 150° F. to 200° F. before step (e).

42. A process for dedusting oil derived from solid hydrocarbon-containing material, comprising the steps of:

(a) dispersing water in oil laden with particulates derived from solid hydrocarbon-containing material to form a first emulsion;

(b) separating said first emulsion in a first desalter into a first dedusted stream of oil having a substantially lower concentration of said particulates than said particulate laden oil and a first stream of water laden with said particulates;

(c) dispersing water in said first dedusted stream after said first dedusted stream has been removed from said first desalter to form a second emulsion;

(d) separating said second emulsion in a second desalter into a second dedusted stream of oil having a substantially lower concentration of said particulates than said first dedusted stream of oil and a second stream of water having a substantially lower concentration of said particulates than said first stream of water;

(e) said particulate laden heavy oil being derived from surface retorting of said solid hydrocarbon-containing material; and (f) said first stream of water is centrifuged, heated in a dryer and combusted in a lift pipe for use as solid heat carrier material in said surface retorting.

43. A process for dedusting oil derived from solid hydrocarbon-containing material, comprising the steps of:

(a) dispersing water in oil laden with particulates derived from solid hydrocarbon-containing material to form a first emulsion;

(b) separating said first emulsion in a first desalter into a first dedusted stream of oil having a substantially lower concentration of said particulates than said particulate laden oil and a first stream of water laden with said particulates;

(c) dispersing water in said first dedusted stream after said first dedusted stream has been removed from said first desalter to form a second emulsion;

(d) separating said second emulsion in a second desalter into a second dedusted stream of oil having a substantially lower concentration of said particulates than said first dedusted stream of oil and a second stream of water having a substantially lower concentration of said particulates than said first stream of water;

(e) said particulate laden heavy oil being derived from surface retorting of said solid hydrocarbon-containing material; and (f) said first stream of water is filtered in a rotary filter, heated in a dryer and combusted in a lift pipe for use as solid heat carrier material in said retort.

44. A process for producing and dedusting shale oil, comprising the steps of:

(a) introducing raw oil shale into a retort;

(b) introducing solid heat carrier material derived from said oil shale into said retort;

(c) retorting said raw oil shale in said retort by mixing said raw oil shale and said solid heat carrier material in said retort at a sufficient retorting temperature to liberate an effluent product stream of hydrocarbons and entrained particulates of shale dust ranging in size from less than 1 micron to 1000 microns;

(d) separating a particulate laden shale oil fraction from said effluent product stream in a separator;

(e) mixing from 10% to 50% by volume water with said removed particulate laden shale oil fraction to form a first emulsion;

(f) separating said first emulsion in a first desalter into a first dedusted stream consisting of normally liquid shale oil and from 1500 ppm to 15,000 ppm by weight shale dust and a first particulate laden water stream consisting of 39% to 76% by weight water, 23% to 60% by weight shale dust and 0.5% to 1% by weight normally liquid shale oil;

(g) removing said first dedusted stream from said first desalter;

(h) mixing from 2% to 7% by volume water with said removed first dedusted stream to form a second emulsion;

(i) separating said second emulsion in a second desalter into a second dedusted stream of normally liquid shale oil containing from 15 ppm to 1500 ppm by weight shale dust and a second stream of water having a substantially lower concentration of shale dust than said first particulate laden water stream;

(j) recycling and using said second stream of water in step (e);

(k) combusting said first particulate laden water stream in a lift pipe to form a spent stream; and (l) using said spent stream as part of said solid heat carrier material in steps (b) and (c).

45. A process for producing and dedusting shale oil, comprising the steps of:

(a) introducing raw oil shale into a retort;

(b) introducing solid heat carrier material derived from said oil shale into said retort;

(c) retorting said raw oil shale in said retort by mixing said raw oil shale and said solid heat carrier material in said retort at a sufficient retorting temperature to liberate an effluent product stream of hydrocarbons and entrained particulates of shale dust ranging in size from less than 1 micron to 1000 microns;

(d) separating a particulate laden shale oil fraction from said effluent product stream in a separator;

(e) mixing from 10% to 50% by volume water with said removed particulate laden shale oil fraction to form a first emulsion;

(f) separating said first emulsion in a first desalter into a first dedusted stream consisting of normally liquid shale oil and from 1500 ppm to 15,000 ppm by weight shale dust and a first particulate laden water stream consisting of 39% to 76% by weight water, 23% to 60% by weight shale dust and 0.5% to 1% by weight normally liquid shale oil;

(g) removing said first dedusted stream from said first desalter;

(h) mixing from 2% to 7% by volume water with said removed first dedusted stream to form a second emulsion;

(i) separating said second emulsion in a second desalter into a second dedusted stream of normally liquid shale oil containing from 15 ppm to 1500 ppm by weight shale dust and a second stream of water having a substantially lower concentration of shale dust than said first particulate laden water stream;

(j) recycling and using said second stream of water in step (e);

(k) centrifuging said first particulate laden water stream into a purified stream of water and a centrifuge sludge having a higher concentration of shale dust than said first particulate laden water stream;

(l) recirculating and using said purified stream of water in step (e) or (h);

(m) mixing said centrifuge sludge with solid heat carrier material in a dryer at a sufficient drying temperature to separate said centrifuge sludge into a third dedusted stream consisting of normally liquid shale oil and less than 5% by weight shale dust and a residual stream consisting of less than 10% by weight normally liquid shale oil and a higher concentration of shale dust than said centrifuge sludge;

(n) combusting said residual stream in a lift pipe to form a spent stream; and (o) using said spent stream as part of said solid heat carrier material in said dryer and said retort.

46. A process for producing and dedusting shale oil, comprising the steps of:

(a) introducing raw oil shale into a retort;

(b) introducing solid heat carrier material derived from said oil shale into said retort; p1 (c) retorting said raw oil shale in said retort by mixing said raw oil shale and said solid heat carrier material in said retort at a sufficient retorting temperature to liberate an effluent product stream of hydrocarbons and entrained particulates of shale dust ranging in size from less than 1 micron to 1000 microns;

(d) separating a particulate laden shale oil fraction consisting of normally liquid shale oil and from 10% to 50% by weight shale dust from said effluent product stream;

(e) dispersing 10% to 50% by volume water in said removed particulate laden shale oil fraction to form a first emulsion;

(f) separating said first emulsion in a first desalter into a first dedusted stream consisting of normally liquid shale oil and from 1500 ppm to 15,000 ppm by weight shale dust and a first particulate laden water stream consisting of 39% to 76% by weight water, 23% to 60% by weight shale dust and 0.5% to 1% by weight normally liquid shale oil;

(g) removing said first dedusted stream from said first desalter;

(h) dispersing 2% to 7% by volume water into said removed first dedusted stream to form a second emulsion;

(i) separating said second emulsion in a second desalter into a second dedusted stream of normally liquid shale oil containing from 15 ppm to 1500 ppm by weight shale dust and a second stream of water having a substantially lower concentration of shale dust than said first particulate laden water stream;

(j) recycling and using said second stream of water in step (e);

(k) removing said second dedusted stream from said second desalter;

(l) dispersing 2% to 7% by volume water into said removed second dedusted stream to form a third emulsion;

(m) separating said third emulsion in a third desalter into a third dedusted stream of normally liquid shale oil containing from 15 ppm to 150 ppm by weight shale dust and third stream of water having a substantially lower concentration of shale dust than said second stream of water;

(n) recycling and using said third stream of water in step (h);

(o) separating said first particulate laden water stream in a centrifuge into a purified stream of water and a centrifuge sludge having a higher concentration of shale dust than said first particulate laden water stream;

(p) mixing said centrifuge sludge with solid heat carrier material in a dryer at a sufficient drying temperature to separate said centrifuge sludge into a fourth dedusted stream consisting of normally liquid shale oil and less than 5% by weight shale dust and a residual stream consisting of less than 10% by weight normally liquid shale oil and a higher concentration of shale dust than said centrifuge sludge;

(q) combusting said residual stream in a lift pipe to form a spent stream; and (r) using said spent stream as part of said solid heat carrier material in said dryer.

47. A process in accordance with claim 46 wherein said fourth purified stream has less than 2% by weight shale dust and said residual stream has from 3% to 8% by weight normally liquid shale oil.

48. A process for dedusting oil derived from solid hydrocarbon-containing material, comprising the steps of:

(a) cooling heavy oil selected from the group consisting of shale oil, tar sands oil, coal oil, lignite oil, peat oil and uintaite oil laden with particulates ranging in size from less than 1 micron to 1000 microns selected from the group consisting of oil shale particulates, tar sands particulates, coal particulates, lignite particulates, peat particulates, and uintaite particulates, to a temperature ranging from 100° F. to 250° F.;

(b) dispersing water in said cooled heavy oil laden with said particulates to form a first emulsion;

(c) separating said first emulsion in a first desalter into a first dedusted stream of heavy oil having a substantially lower concentration of said particulates than said particulate laden oil and a first stream of water laden with said particulates;

(d) dispersing water in said first dedusted stream after said first dedusted stream has been removed from said first desalter to form a second emulsion;

(e) separating said second emulsion in a second desalter into a second dedusted stream of heavy oil have a substantially lower concentration of said particulates that said first dedusted stream of heavy oil and a second stream of water having a substantially lower concentration of said particulates than said first stream of water;

(f) removing said first stream of water laden with said particulates from said first desalter;

(g) combusting said removed first stream of water laden with said particulates to form a spent stream; and (h) feeding said spent stream to a surface retort for use as solid heat carrier material in retorting raw solid hydrocarbon-containing material.

49. A process in accordance with claim 48 where said second stream of water from said second desalter is directly recycled upstream of said first desalter for use in step (a) without centrifuging said second stream of water.

50. A process in accordance with claim 48 wherein water is dispersed in said second dedusted stream of heavy oil after said second dedusted stream of oil has been removed from said second desalter to form a third emulsion and said third emulsion is separated in a third desalter into a third stream of water and a third dedusted stream of heavy oil having a substantially lower concentration of particulates than said second dedusted stream of heavy oil.

* * * * *

UNITED STATES PATENT OFFICE

CERTIFICATE OF CORRECTION

Patent No. 4,415,434 Dated November 15, 1983

Inventor(s) HARGREAVES, JAY T. - HENSLEY, ALBERT L.

It is certified that error appears in the above-identified patent and that said Letters Patent are hereby corrected as shown below:

| Column | Line | | | |
|---|---|---|---|---|
| 1 | 43 | after "ethane," | | add --ethene,-- |
| 2 | 30 | "hudrocarbons" | should be | -- hydrocarbon-- |
| 3 | 26 | "hudrocloning" | should be | -- hydrocloning-- |
| 4 | 1 | "is" | should be | -- in-- |
| 4 | 14 | "Sept. 30, 1974)" | should be | --(Sept. 30, 1974)-- |
| 12 | 39 | "thrugh" | should be | -- through-- |
| 13 | 16 | "follower" | should be | -- followed-- |
| 14 | 10-11 | "before before" | should be | -- before--(delete 1"before") |
| 14 | 16 | "is" (first occurence) | should be | -- in-- |
| 15 | 46 | "pisa" | should be | -- psia-- |
| 17 | 28 | "." | should be | -- ; -- |
| 18 | 17 | "60°F" | should be | --600°F-- |
| 19 | 17 | after "said" | | add --first-- |
| 19 | 62 | "centistrokes" | should be | --centistokes-- |
| 22 | 36 | delete "pl" | | |

Signed and Sealed this

Third Day of April 1984

[SEAL]

Attest:

GERALD J. MOSSINGHOFF

Attesting Officer

Commissioner of Patents and Trademarks